US005184765A

United States Patent [19]

Orozco

[11] Patent Number: 5,184,765

[45] Date of Patent: Feb. 9, 1993

[54] PERFORATOR COUPLED WITH STAPLER AND STAPLE REMOVER AND THEIR EMBODIMENTS

[76] Inventor: Hector M. Orozco, Av. Prolongacion Constitucion 57, Colonia Santiago Tepetlacalco Delegacion Xochimilco, Mexico D.F., 16200, Mexico

[21] Appl. No.: 819,951

[22] Filed: Jan. 13, 1992

[51] Int. Cl.[5] ..... B25C 7/00

[52] U.S. Cl. ..... 227/27; 227/68

[58] Field of Search ..... 227/27, 67, 68; 30/123

[56] References Cited

U.S. PATENT DOCUMENTS

| | | | |
|---|---|---|---|
| 3,577,575 | 5/1971 | Taniguchi | 30/123 |
| 4,783,867 | 11/1988 | Tsao | 30/123 |
| 4,988,030 | 1/1991 | Muramata et al. | 227/27 |

FOREIGN PATENT DOCUMENTS

| | | | |
|---|---|---|---|
| 808466 | 6/1953 | Fed. Rep. of Germany | 227/68 |
| 2-279282 | 11/1990 | Japan | 227/68 |

*Primary Examiner*—Frank T. Yost
*Assistant Examiner*—Scot A. Smith
*Attorney, Agent, or Firm*—Harrison & Egbert

[57] ABSTRACT

A stapling and perforating apparatus having a base with downwardly bent edges, a support plate affixed to the base and extending vertically upwardly therefrom, a stapler pivotally interconnected to and above the base, a punch interconnected to the base above the support plate, a plurality of cylindrically-shaped protuberances extending upwardly from the base a desired distance from the punch, a tray removably fastened to the base, and a generally flat lancet having hewn edges slidably received within a slot formed in the stapler. The punch is mounted on a structure fastened to the support plate. An impact button is provided on one end of the punch. A spring resiliently maintains the impact button above the structure. The protuberances are in linear alignment and are offset from the plane of the support plate. The downwardly extending edge of the base defines a receptacle box area below the base.

4 Claims, 4 Drawing Sheets

PERFORATOR COUPLED WITH STAPLER AND STAPLE REMOVER AND THEIR EMBODIMENTS

TECHNICAL FIELD

This invention refers to a novel combined perforator which also incorporates a stapler and staple remover, and therefore its field of action is restricted to normal file operations in an office or in the home.

Despite the above, the principles of this invention can be used in other fields of industry or commerce which requires perforating other types of materials than a sheet of paper, in which case, the dimensions and construction materials of the perforator, reason for this invention, will be modified in such a way as to comply with and satisfy the specifications, and consequently this will not mean a restriction on its use, but rather on the contrary, a possible wider application of the invention.

BACKGROUND OF THE INVENTION

As is known, to develop mainly file activities in an office, it is necessary to perforate the sheets frequently, and different systems have been developed from box archives to the more conventional of joining them via clasps or fastening posts with the paper sheets previously perforated. Perforators are normally used with two piercings in each sheet toward the left margin, or toward the upper part. However, depending on the means of fastening, three or four piercings in the sheets may be used.

As will be understood in solving the problems of many piercings, different types or models of perforators have been developed for the number of perforations.

Thus, in this case, the user has to purchase both a two-hole perforator and a three-hole one, which becomes an additional expenditure for the user.

These inconveniences can be eliminated with the incorporation of a perforation system like the one proposed for this invention, which has the advantage either of incorporating a conventional stapler in such a way as to form a single article or piece, particularly if designed for perforating one, two, three or more piercings in a simple form, with distribution of an equal distance between all the perforations, adjusted to the conventional dimensions of those correlative to clasps, folder rings or the file elements to be used. Finally, by using this system, the distance between the margin and the piercing is always the same, which is very advantageous, since in this way all the perforated sheets will coincide.

On the other hand, it is also necessary to do the sheet stapling and staple removing operation. For the first operation there is a large number of models. The fundamental differences in the staplers consist in the manner of loading the staples in an appropriate deposit in the form of a cartridge holder so that they are used as necessary. At the same time, these are found on the market in different sizes for satisfying all the needs of users, although some have the inconvenience of being closed at the end part of the stapling, and if a staple becomes stuck, it is difficult to examine and in the end repair.

SUMMARY OF THE INVENTION

This invention refers to a novel desk perforator for piercing paper sheets with one, two, three or more piercings which is incorporated to a stapler and with a stapler remover in such a way a to have a single piece.

The characteristic details of the invention are seen more clearly with the following drawings, which serve as reference signs for denoting the details.

DETAILED DESCRIPTION OF THE INVENTION

Figure 2:
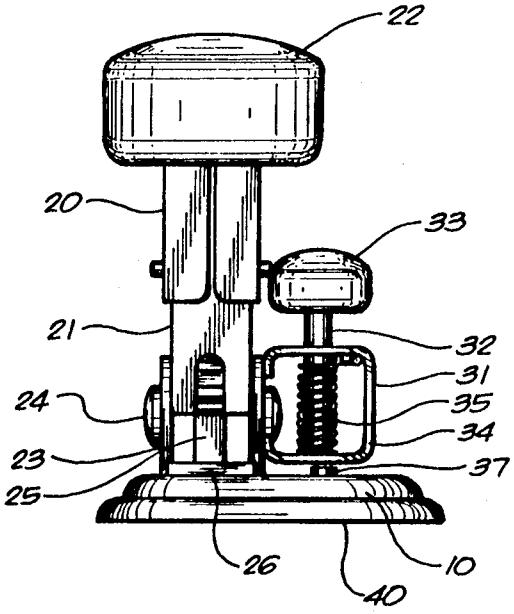
FIG. 2 is another front view of the same perforator and stapler.
Figure 1:
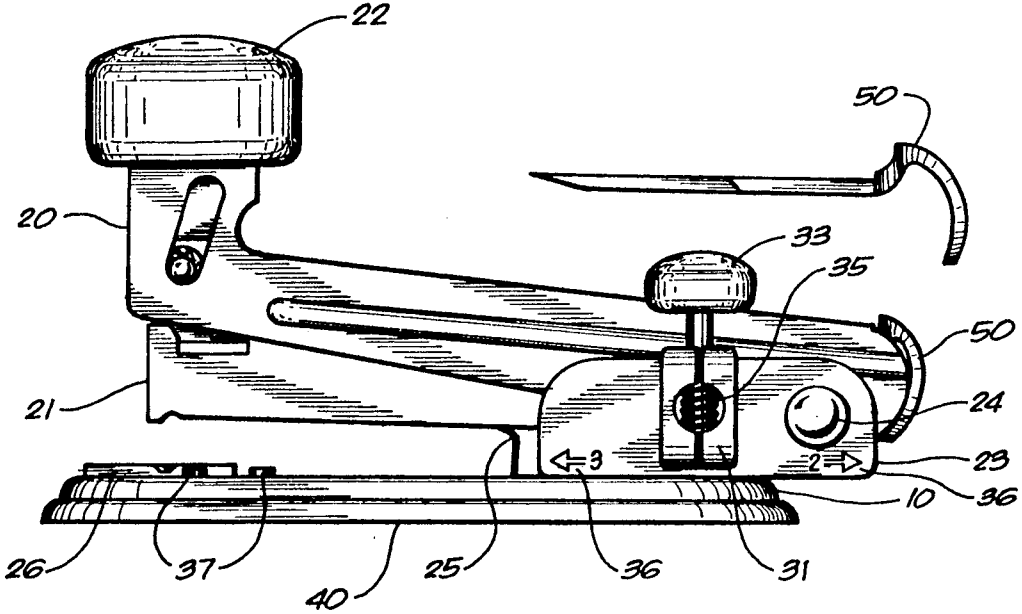
FIG. 1 is a side view, showing the whole of the perforator, with the stapler integrated.
Figure 3:
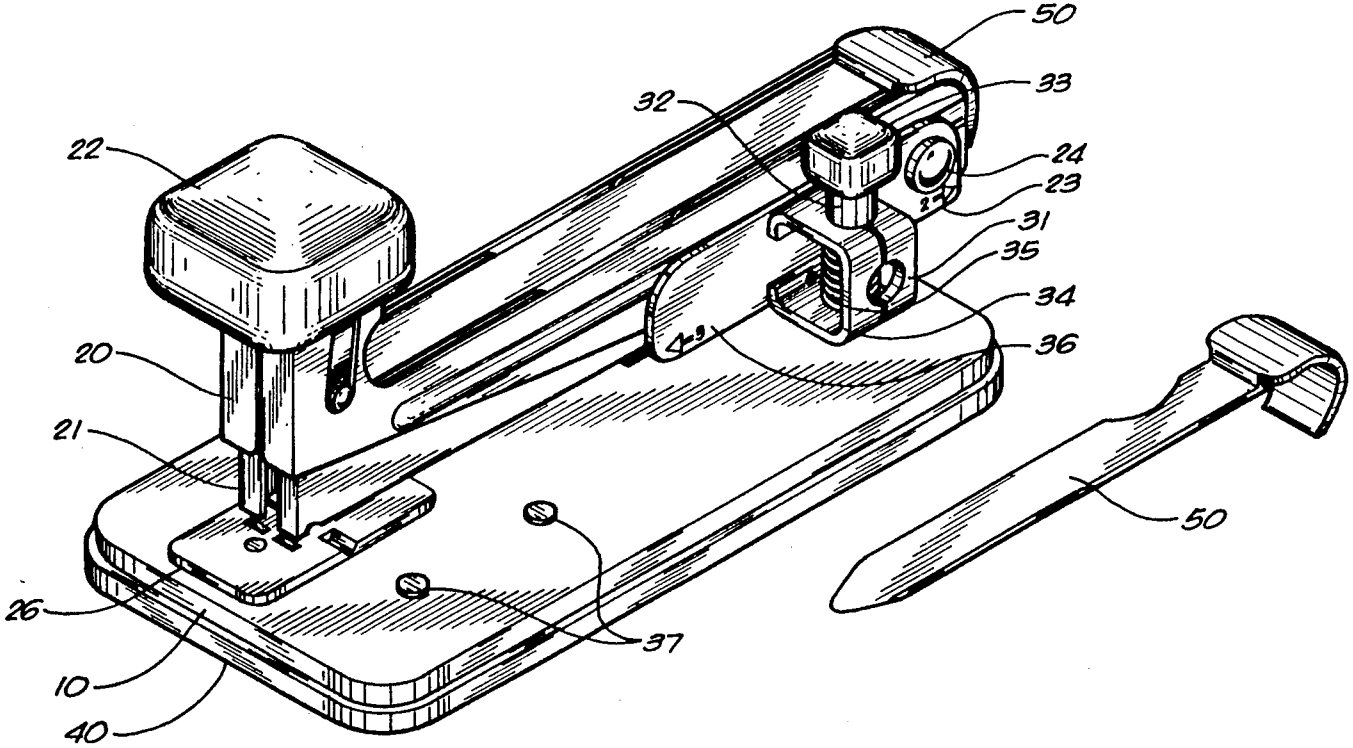
FIG. 3 gives a conventional perspective of the same perforator together with the stapler.
Figure 4:
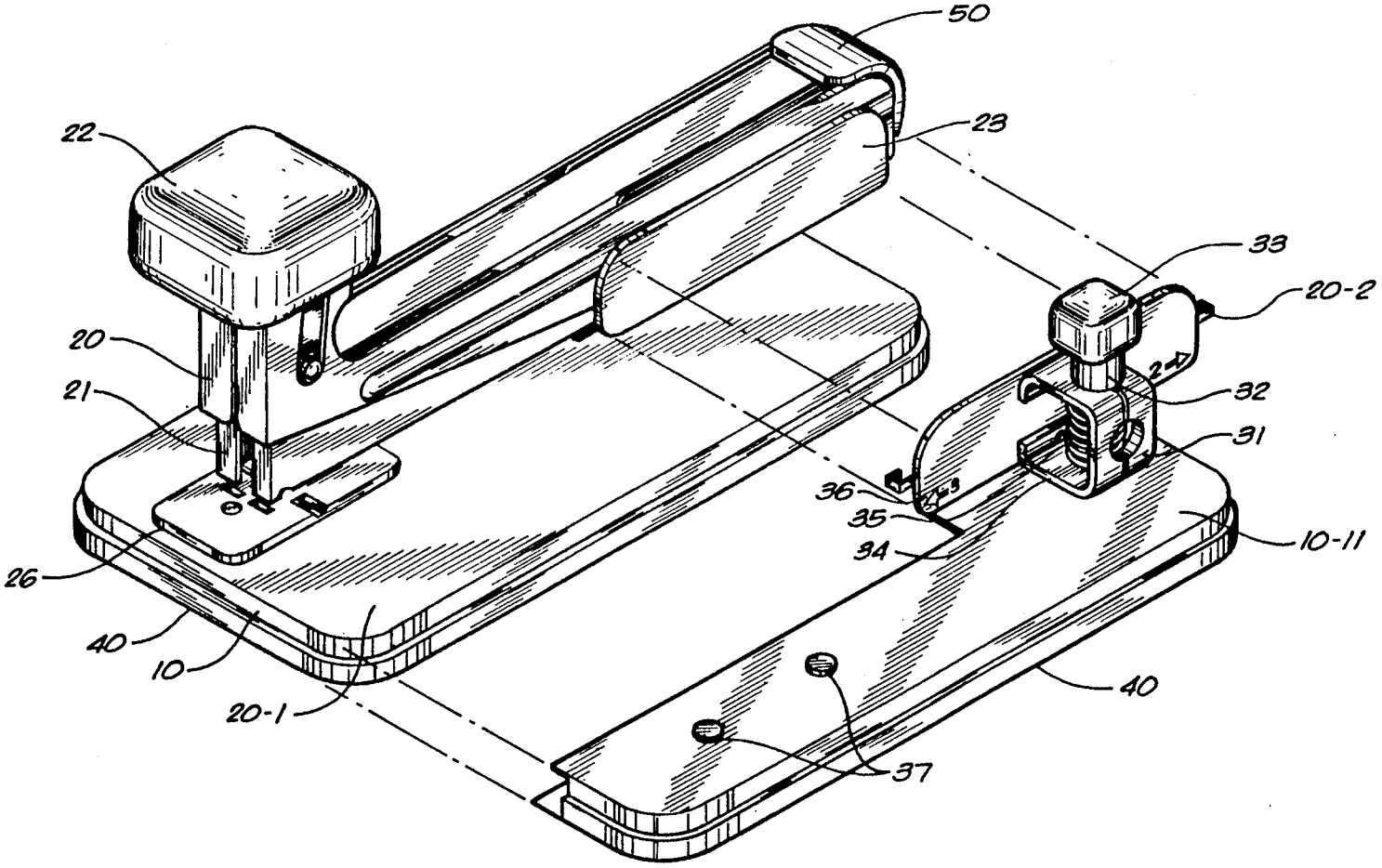
FIG. 4 represents a conventional view of only the perforator together with its fastening elements for a conventional stapler.
Figure 5:
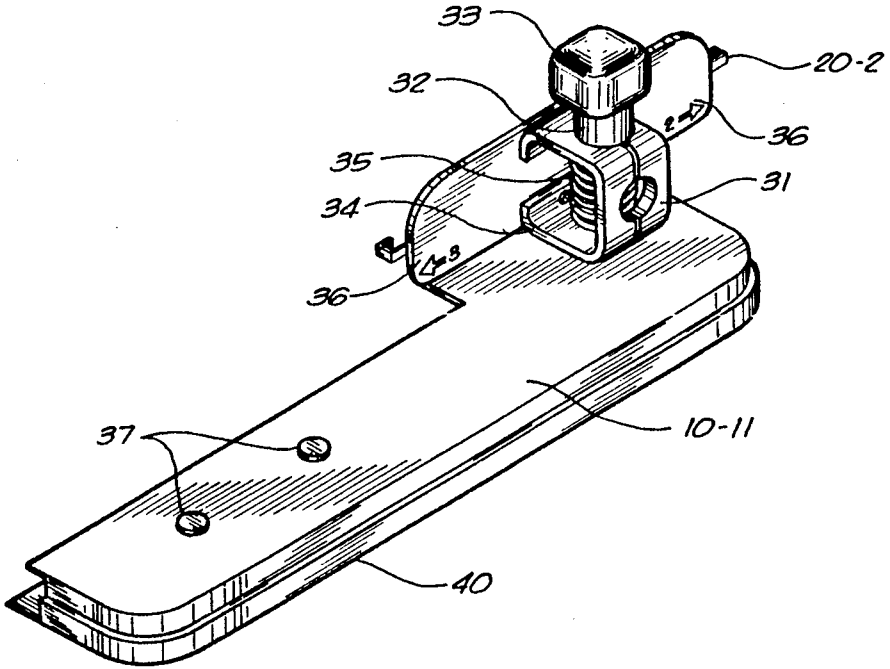
FIG. 5 represents a view of the fastening system.

In reference to these figures, this invention is formed by a base (10) in a rectangular form with appropriate dimensions and materials for supporting normal treatment in an office, with the characteristic of being able to bend its edges downward, forming a small register box. On the base (10) a stapler (20) is offset to one side, formed by a cartridge holder (21) where the staples are lodged or placed, which are pushed by the whole of a channel and spring. The spring is designed in appropriate dimensions and materials in order to exercise uniform force. An impact button (22) duly reinforced to support the force exercised by the blow at the time of stapling is installed above the cartridge holder (21). The body of the stapler (20) is fastened through a small groove (23) and a bolt (24) as well as a spring (25). A plate for bending the staples (26) has two positions, which move via movement of the plate (26) toward the front and vice versa.

Attached to the groove (23) of the stapler is a small structure (31) which has toward its interior a shaft (32) which forms the punch element of the perforator, and having toward the upper end, an impact button (33), duly reinforced and downward, a hewn point (34) for appropriate perforation of the sheets. Toward the inside of the structure (31), the shaft (32) comprises a spring (35), duly adjusted and joined to the shaft (32) with which it maintains an upward position of this shaft. Toward the ends of the groove (23) there are some markings (36) as references for the piercing of two or three-hole sheets.

Toward the side of the base of the stapler (10) there are some perforation terminals or registers (37) with indications for two or three perforations, in a cylindrical form and raised with appropriate size and dimensions to receive those paper sheets which are already perforated, and in this way have the security that the perforated sheets will have the same distance.

In order to receive and keep the perforated waste paper, there is a receiving tray (40) which covers all the edge of the base (19).

As an embodiment of this invention, there is an extension of the stapler base (10-11) with some fastening and pressure elements (20-2) for joining to a conventional stapler (20-1) and in this way convert it into a single desk article with the versatility of having a multiple perforator.

Lastly, in order to remove the staples and open letters, there is a flat lancet (50) with its edges cut back and ending in a point to be introduced between the staple and the paper and in this way remove the staple. It is incorporated and placed toward an end of the stapler (29).

As for its operation, it is the most simple, as it is sufficient to follow the following rules: if it is desired to perforate a sheet with two holes, the page is marked half-way and this mark is put at the right end where the number two is marked of the support plate (36); the sheet is pierced by pressing the impact button (33); the perforated sheet is brought toward the left until it is coincident with the hole with the opening marked with number two (37) in order to again do the perforating operation. If three perforations are to be made, the left end of the sheet is made to coincide with the left end of the support plate (36) where it is marked with number three; the sheet is pierced by pressing the button (33); the sheet is moved to the left until the piercing coincides with the opening marked with number three (37); the button or knob (33) is again pressed; the sheet is again moved toward the left until the second hole of the sheet coincides again with the opening with number three (37); the perforating operation is done again.

I claim:

1. A stapling and perforating apparatus comprising:

a rectangular-shaped base having downwardly bent edges, said edges defining a box area below said base;

a support plate affixed to said base and extending upwardly therefrom, said support plate having a flat vertical surface extending from said base;

a stapler pivotally interconnected to and above said base;

a single punch interconnected to said base generally adjacent to said support plate, said punch mounted on a structure, said punch having an impact button on one end, said punch having a spring for maintaining said impact button in a position above said structure;

a plurality of cylindricallyshaped protuberances extending upwardly from said base a desired distance form said punch, said protuberances being in linear alignment, said protuberances being offset form a plane of said support plate;

a tray removably fastened to said box area below said base, said tray for receiving waste particles formed from a perforation by said punch; and a generally flat lancet having hewn edges slidably received within a slot formed in said stapler.

2. The apparatus of claim 1, said stapler connected to said base by a fastening spring, said fastening spring resiliently supporting said stapler above said base, said stapler separable from said fastening spring upon application of an upward force to said stapler.

3. The apparatus of claim 1, said protuberances having a diameter generally equal to a diameter of said punch, said protuberances for receiving a punched hole in a sheet of paper.

4. The apparatus of claim 1, said lancet having a curved end extending outwardly from said slot at an end of said stapler.

* * * * *